US006199333B1

(12) United States Patent
Viduka, Jr.

(10) Patent No.: US 6,199,333 B1
(45) Date of Patent: Mar. 13, 2001

(54) REBAR PROTECTION STRIP

(75) Inventor: Richard V. Viduka, Jr., Palmdale, CA (US)

(73) Assignee: Lomont Molding, Inc., Mt. Pleasant, IA (US)

( * ) Notice: Subject to any disclaimer, the term of this patent is extended or adjusted under 35 U.S.C. 154(b) by 0 days.

(21) Appl. No.: 09/365,925

(22) Filed: Aug. 3, 1999

Related U.S. Application Data

(60) Provisional application No. 60/095,123, filed on Aug. 3, 1998.

(51) Int. Cl.[7] ..... E04H 12/00

(52) U.S. Cl. ..... 52/300; 52/301; 256/59; 256/65

(58) Field of Search ..... 52/300, 301; 256/59, 256/65, 68, 24, 19

(56) References Cited

U.S. PATENT DOCUMENTS

| | | | | |
|---|---|---|---|---|
| 2,450,345 | * | 9/1948 | Kervin | 52/301 |
| 3,982,735 | * | 9/1976 | Fornells | 256/59 |
| 5,200,240 | * | 4/1993 | Baker | 256/59 X |
| 5,299,883 | * | 4/1994 | Arth, Jr. | 52/301 X |
| 5,381,636 | * | 1/1995 | Kassardjian et al. | 52/300 X |
| 5,447,290 | * | 9/1995 | Workman | 256/59 |
| 5,529,288 | * | 6/1996 | Cheng-I | 256/65 |
| 5,613,336 | * | 3/1997 | Workman | 52/301 |
| 5,649,688 | * | 7/1997 | Baker | 256/59 X |
| 5,729,941 | * | 3/1998 | Kassardjian et al. | 52/301 |
| 5,826,398 | * | 10/1998 | Carnicle | 52/301 X |
| 5,884,443 | * | 3/1999 | Schimmelpfennig | 52/301 |
| 5,943,836 | * | 8/1999 | Kassardjian et al. | 52/300 X |
| 5,950,680 | * | 9/1999 | Randall | 52/301 X |
| 5,967,498 | * | 10/1999 | Junell | 256/59 X |
| 6,085,478 | * | 7/2000 | Workman | 52/300 X |

* cited by examiner

*Primary Examiner*—Peter M. Cuomo
*Assistant Examiner*—Rodney B. White
(74) *Attorney, Agent, or Firm*—Zarley, McKee, Thomte, Voorhees & Sease

(57) ABSTRACT

An elongated strip for covering the ends of a row of spaced protruding reinforcing bars has an elongated body member having a substantial horizontal top with outer and inner surfaces, and with parallel side edges. A pair of converging side walls extend downwardly and inwardly from the side edges of the top and terminate in lower ends which define an openable throat portion normally having a breadth less than the diameter of reinforcing bars upon which the body member is to be placed. The body member is at least partially resilient and spring-like so that the throat portion can be manually opened sufficiently to receive the ends of a row of reinforcing bars. At least two oppositely disposed elongated protruding ribs extend inwardly from the inner surface of the side walls of the body member to frictionally engage reinforcing bars extending through the opened throat portion and in between adjacent ends of the ribs. The body member has sufficiently resilient and spring-like properties so that when the throat portion is manually opened, the ends of a row of spaced protruding reinforcing bars can move from the inner ends of the ribs and be frictionally engaged thereby at least when the body member is manually released to allow the throat portion to move towards its original position.

8 Claims, 3 Drawing Sheets

REBAR PROTECTION STRIP

This application is based upon provisional application Ser. No. 60/095,123 filed Aug. 3, 1998.

BACKGROUND OF THE INVENTION

It is common in a majority of construction projects to have vertically disposed spaced reinforcing bars protruding from a poured concrete wall or footing, for example. The protruding reinforcing bars are used for connection to a further wall segment to be poured thereafter. Commonly, additional reinforcing bars are secured to the protruding bars when the second wall segment is poured.

The ends of the protruding reinforcing bars create a safety hazard because a worker falling on the bars can be impaled thereby or otherwise will be subjected to severe injury.

As a result, certain governmental agencies require that the ends of the exposed bars be covered with some sort of a buffer element to prevent the impalement of a worker by the bars who might fall thereon. The placement of a separate cap or buffer on each of the bars is expensive and time consuming. Some efforts have been made to provide a cover for a plurality of bars. One example is shown in U.S. Pat. No. 5,447,290 issued Sep. 5, 1995. However, such devices are difficult to install because they are difficult to align on the bars, and they are difficult to secure the covers to the bars for they require the use of nuts and bolts extending laterally therethrough which also requires the utilization of certain hand tools to complete this function. These attachment devices also will often damage aluminum electrical conduit which also might be invented in the wall.

It is therefore a principal object of this invention to provide an elongated strip for covering the ends of a row of spaced protruding reinforcing bars which can be easily installed without the use of special tools.

It is a further object of this invention to provide an elongated strip for covering the ends of a row of spaced protruding reinforcing bars which will involve less labor to install and remove, which is of lighter weight, inexpensive to manufacture, and refined in appearance.

It is a further object of this invention to provide an elongated strip for covering the ends of any protruding sharp instruments such as picket fences and gates, and reinforcing rods whether they be vertically, horizontally, or an angular position.

A still further object of this invention is to provide an elongated strip for covering the ends of a row of spaced protruding reinforcing bars which will stack and chip efficiently.

These and other objects will be apparent to those skilled in the art.

SUMMARY OF THE INVENTION

An elongated strip for covering the ends of a row of spaced protruding reinforcing bars has an elongated body member having a substantial horizontal top with outer and inner surfaces, and with parallel side edges. A pair of converging side walls extend downwardly and inwardly from the side edges of the top and terminate in lower ends which define an openable throat portion normally having a breadth less than the diameter of reinforcing bars upon which the body member is to be placed.

The body member is at least partially resilient and spring-like so that the throat portion can be manually opened sufficiently to receive the ends of a row of reinforcing bars.

At least two oppositely disposed elongated protruding ribs extend inwardly from the inner surface of the side walls of the body member to frictionally engage reinforcing bars extending through the opened throat portion and in between adjacent ends of the ribs. The body member has sufficiently resilient and spring-like properties so that when the throat portion is manually opened, the ends of a row of spaced protruding reinforcing bars can move from the inner ends of the ribs and be frictionally engaged thereby at least when the body member is manually released to allow the throat portion to move towards its original position.

DESCRIPTION OF THE PREFERRED EMBODIMENT

Figure 2:
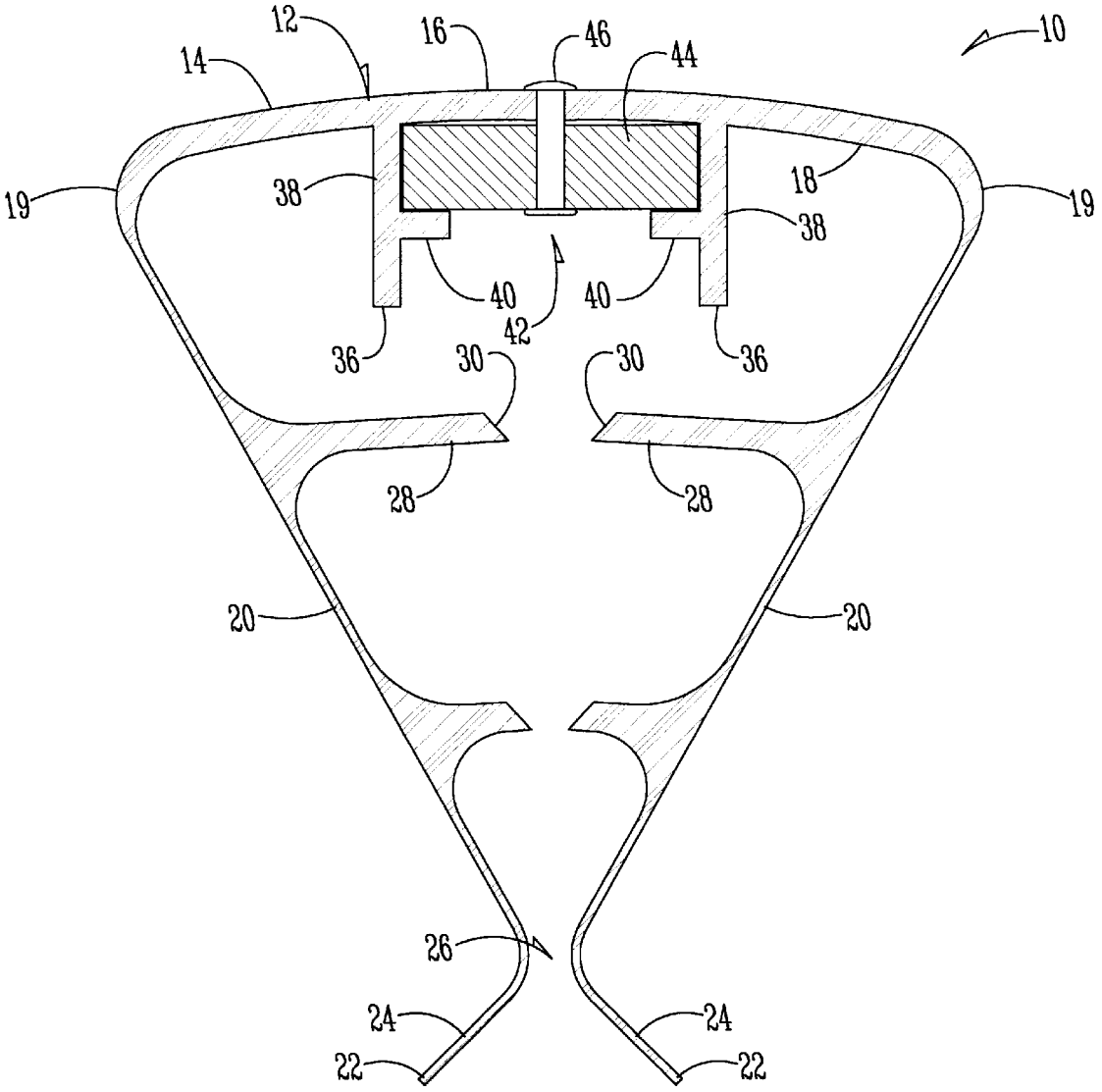
FIG. 2 is a cross sectional view of the strip of this invention.
Figure 3:
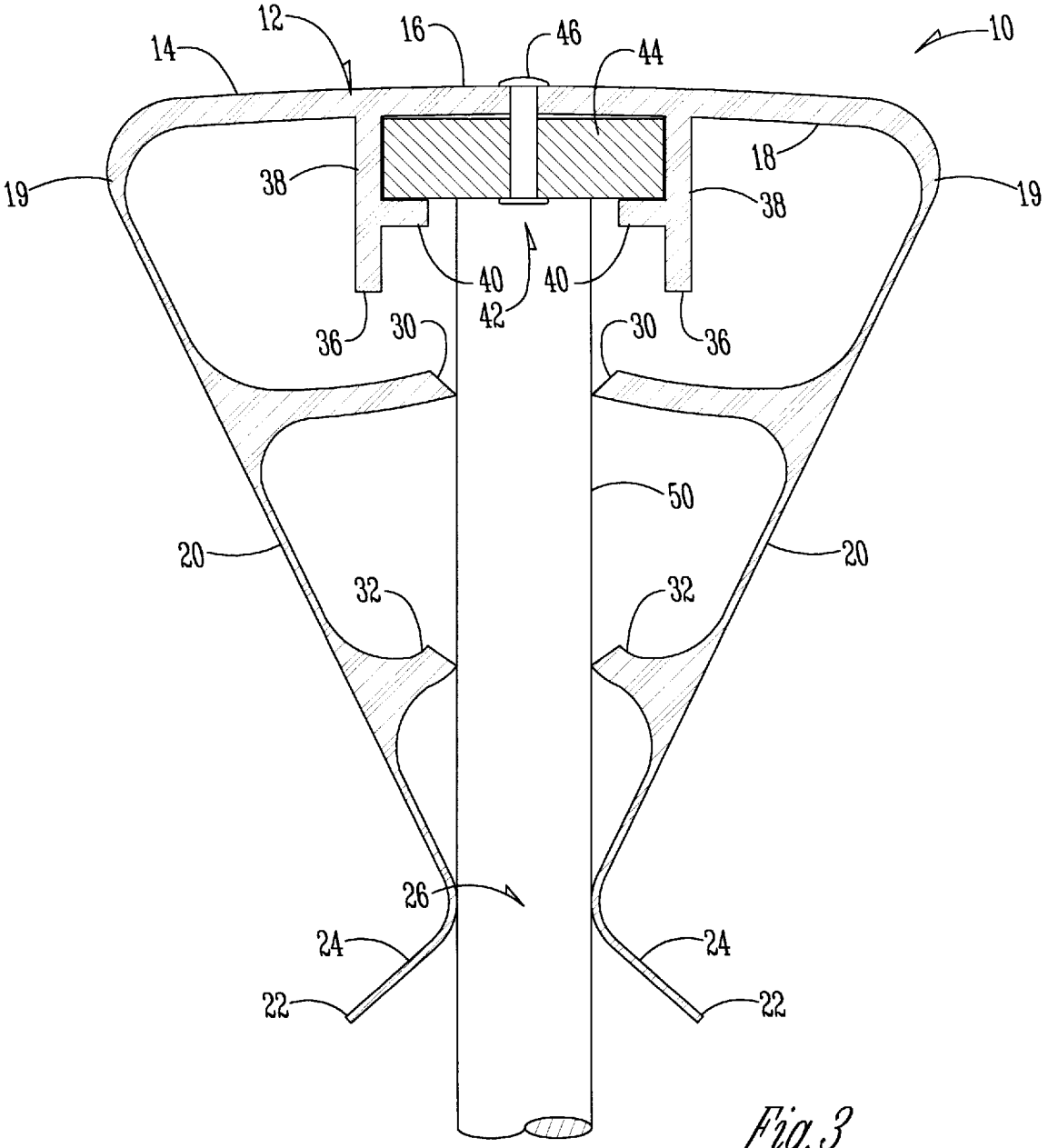
FIG. 3 is a sectional view similar to that of FIG. 2 but shows the strip being mounted on a row of protruding reinforcing bars.

With reference to FIGS. 2 and 3, the numeral 10 designates the protection strip of this invention which include a body member 12 which is normally about 4 to 6 feet in length, 4 inches wide at its top, and 4 ½ inches from its top to its bottom. The body member 12 has a top 14 which has an outer surface 16 and an inner surface 18. The top has side edges 19 to which side walls 20 are attached and extend downwardly and inwardly. Side walls 20 terminate in lower ends 22. Flanges 24 extend outwardly and downwardly away from throat portion 26. Body member 12 is preferably made of extruded polypropylene and is of stiff but resilient construction with a thickness of 0.2 inches at its top and 0.110 inches at its side walls. As also shown in FIGS. 2 and 3, horizontal ribs 28 are secured to the inner surfaces of side walls 20. Ribs 28 have spaced inner ends 30 which are tapered. Similarly, ribs 32 protrude inwardly from the inner surfaces of side walls 20 below the ribs 28. The inner ends 34 of ribs 32 are also tapered in the same manner that the inner ends 30 of ribs 38 were tapered.

It should be noted in FIG. 3 that the normal resilient configuration of body member 12 is such that the throat portion 26 is very narrow if not completely closed, and the inner ends of ribs 28 and 32 are closely spaced so as not to permit the free movement of a reinforcing rod ½ inch in diameter to freely move therethrough. As will be described more fully hereafter, the body member 12 must be subjected to manual force to spread the side walls 20 apart to open the throat portion 26 so that a reinforcing rod can be introduced through the throat portion 26 and between the inner ends of ribs 28 and 32.

As also shown in FIGS. 2 and 3, a channel 36 is formed within the interior of body member 12. Channel 36 is comprised of two spaced vertical walls 38 which have tabs 40 extending laterally therefrom to create opening 42. As shown in FIG. 3, a flat bearing bar 44 extends the length of the channel 36 and adapted to provide a bearing surface for the upper ends of the reinforcing bars. Rivets 46 can be used to secure the bearing bars 44 to the top 14 of body member 12.

Figure 1:
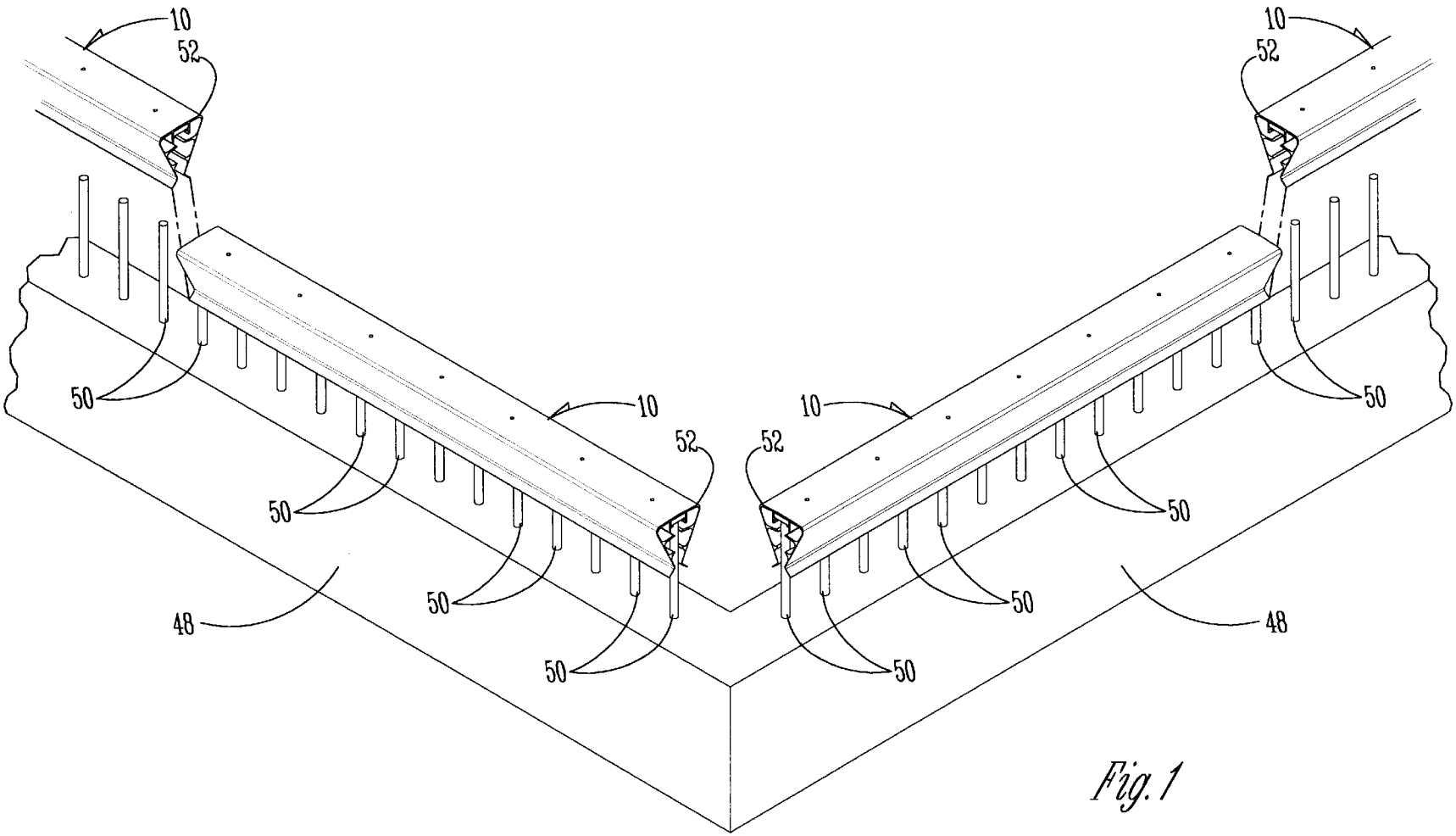
In FIG. 1 is a perspective view of rows of protruding reinforcing bars being covered by the device of this invention.

As shown in FIG. 1, a poured concrete wall 48 has a plurality of reinforcing rods 50 with upper ends 52 rigidly secured therein and protruding therefrom. While the concrete in wall 48 is curing, and before the next segment of wall is poured on top of wall 48, it is necessary to cover the upper ends 52 of rods 50 to prevent injury to anyone falling upon the rods. This is accomplished by this invention wherein the strips 10 are placed end to end on a given row of rods. This is accomplished by manually spreading the throat 26 either by deflecting the side walls 20 or taking advantage of a natural live hinge coincidental with side edges 19 of the top 14 of the body member 12. The flanges 24 facilitate the entry of the rods 50 through the throat portion 26 and between the inner ends of ribs 28 and 32. The device of this invention will accommodate reinforcing rods of various diameters normally in a range of ½ inch to more than 1 inch in diameter. The body member 12 is then pushed downwardly so that the rods move between the inner ends of ribs 28 and 32, and so that the upper ends 52 of the rods engage the body surface of the bearing bar 44. The ribs 28 and 32 frictionally engage the rods to hold the body member 12 on the rods without any additional bolts or the like or without any tools whatsoever. Depending on the diameter of the rods 20, the ribs 28 and 30 are sometimes slightly deflected. However, the tapered ends 30 of the ribs frictionally engage the rods therebetween whether the ribs are deflected or not. Typically, the inner ends of the ribs 28 and 30 do yieldingly engage the rod while the body member 12 is being moved into position.

This assembly is accomplished by a workman 54. Disassembly for the strip is accomplished by reversing the foregoing process.

It is therefore seen that this invention will accomplish at least all of its stated objectives.

What is claimed is:

1. An elongated strip for covering exposed ends of a row of spaced apart protruding reinforcing bars of a given diameter, comprising, an elongated body member having a substantially horizontal top with outer and inner surfaces, and with parallel side edges, a pair of converging side walls extending downwardly and inwardly from the side edges of the top and having inner surfaces terminating in lower ends which define an operable throat portion normally having a breadth therebetween less than the diameter of reinforcing bars upon which the body member is to be placed, the body member being at least partially resilient so that the throat portion can be manually opened sufficiently from an original position to a broader open position to receive the exposed ends of a row of reinforcing bars, and at least two oppositely disposed elongated protruding ribs having outer ends attached to the inner surface and free ends extending inwardly from the inner surface of the side walls to frictionally engage reinforcing bars extending through the opened throat portion and in between adjacent free ends of the ribs, the body member being sufficiently resilient so that when the throat portion is manually opened, the exposed ends of a row of spaced apart protruding reinforcing bars can move between the inner ends of the ribs and be frictionally engaged thereby at least when the body member is manually released to allow the throat portion to move towards the original position before being manually opened; and a second pair of oppositely disposed elongated protruding ribs extending inwardly to function similarly with the first mentioned ribs with respect to the reinforcing bars extending through the opened throat portion.

2. The device of claim 1 wherein a stiff horizontal flat bearing bar is secured to the inner surface of the top of the body member to provide a bearing surface for the ends of reinforcing bars within the body member.

3. The device of claim 2 wherein the bearing bar is secured to the top of the body member.

4. The device of claim 2 wherein a channel is formed within the body member for containing the bearing bar.

5. The device of claim 1 wherein a flange extends downwardly and outwardly from the lower end of each of the side walls to guide the exposed ends of a row of reinforcing bars into the throat portion.

6. The device of claim 1 wherein the body member is comprised of extruded resilient plastic.

7. The device of claim 1 wherein the inner ends of the ribs are tapered upwardly and outwardly from a line of contact with the diameter of the reinforcing bars to enhance the frictional engagement with the reinforcing bars.

8. The device of claim 1 wherein the ribs are of stiff resilient material.

* * * * *